US007339856B1

(12) United States Patent
Hardesty

(10) Patent No.: US 7,339,856 B1
(45) Date of Patent: Mar. 4, 2008

(54) CLOCK WITH SPORTS MOTIF

(76) Inventor: Kevin Hardesty, 2203 Wagon Wheel Trail, Corinth, TX (US) 76208

( * ) Notice: Subject to any disclaimer, the term of this patent is extended or adjusted under 35 U.S.C. 154(b) by 0 days.

(21) Appl. No.: 11/403,115

(22) Filed: Apr. 12, 2006

Related U.S. Application Data

(60) Provisional application No. 60/670,581, filed on Apr. 12, 2005.

(51) Int. Cl.
*G04B 19/04* (2006.01)

(52) U.S. Cl. ..... 368/228; 368/223

(58) Field of Classification Search ..... 368/223, 368/276, 80, 228, 232, 238
See application file for complete search history.

(56) References Cited

U.S. PATENT DOCUMENTS

| | | | | |
|---|---|---|---|---|
| 3,595,010 | A * | 7/1971 | Kaiser | 368/76 |
| 4,725,061 | A * | 2/1988 | Gross | 273/157 R |
| 4,759,002 | A * | 7/1988 | Cash | 368/15 |
| D302,796 | S | 8/1989 | Goolsby | |
| D325,349 | S | 4/1992 | Perri | |
| 5,216,642 | A | 6/1993 | Rikkers | |
| D343,126 | S | 1/1994 | McNeely | |
| 5,375,102 | A * | 12/1994 | Schiavolini | 368/10 |
| 5,380,206 | A * | 1/1995 | Asprey | 434/257 |
| D357,883 | S | 5/1995 | Krauss | |
| D373,314 | S | 9/1996 | Staszak | |
| D395,830 | S * | 7/1998 | Riley | D10/4 |
| 5,793,710 | A * | 8/1998 | Jacobi, Jr. | 368/223 |
| 5,844,863 | A * | 12/1998 | Voss et al. | 368/88 |
| 5,862,102 | A * | 1/1999 | Trainello | 368/223 |
| 5,896,349 | A * | 4/1999 | Haze | 368/228 |
| D411,962 | S | 7/1999 | Hewitt | |
| 6,278,664 | B1 * | 8/2001 | Huffman et al. | 368/223 |
| 6,556,514 | B2 * | 4/2003 | Fernandez | 368/223 |
| 2003/0231555 | A1 * | 12/2003 | Sullivan | 368/223 |

* cited by examiner

*Primary Examiner*—Vit Miska
*Assistant Examiner*—Jeanne-Marguerite Goodwin
(74) *Attorney, Agent, or Firm*—Robert C. Montgomery

(57) ABSTRACT

A novel device for displaying the correct time comprises a clock with interchangeable and attachable panels comprising decorative indicia or figures; a second hand with replaceable indicia or figures, minute hand, and hour hand; and means to drive said timing hands. The interchangeable panel is removably attached to the front face of a clock with a viewing window for viewing the normal travel of the second, minute, and hour hands. The movement of the second hand with the replaceable indicia simulates a sports action as it moves from the 9:00 position to the 3:00 position.

1 Claim, 2 Drawing Sheets

CLOCK WITH SPORTS MOTIF

RELATED APPLICATIONS

The present invention was first described in Disclosure Document No. 561,144 filed on Sep. 20, 2004 and in U.S. Provisional Patent Application No. 60/670,581 filed on Apr. 12, 2005. There are no previously filed, nor are there currently any co-pending applications, anywhere in the world.

FIELD OF THE INVENTION

The present invention relates generally to a time device. More particularly, the invention relates to a time device having a removably attached decorative theme, preferably a sports motif, for timepieces such as clocks and the like.

BACKGROUND OF THE INVENTION

Modern fashion trends dictate an ever evolving and changing popularity. Clothing and accessories that are considered cutting edge today are considered passe tomorrow. In keeping with these trends, society's strong desire to be different and its willingness to be judged by the clothes and fashions that one wears, the industry is constantly searching for new and innovative styles that will help to define the next fashion trend. Not limited strictly to clothing, this need for innovation extends to all areas of personal and household fashion, including that of accessories, particularly timepieces.

Several attempts have been made in the past to provide a timekeeping device such as a clock with an ornamental and decorative sports theme. U.S. Pat. No. 5,216,642 in the name of Rikkers discloses a clock assembly with an enlarged planar support for receiving a picture and a secondary support surface for receiving a second picture. The Rikkers device does not include interchangeable sports motif characters with a detachable face with corresponding insignia thereon as in the present invention.

Other devices particularly concerned with the ornamental design for a clock or other timepiece with a sports motif have been issued, notably U.S. Pat. No. D343,126 issued in the name of McNeely; U.S. Pat. No. D325,349 issued in the name of Perri; U.S. Pat. No. D302,796 issued in the name of Goolsby; U.S. Pat. No. D373,314 issued in the name of Staszak; and, U.S. Pat. No. D411,962 issued in the name of Hewitt. None of these patents, although unique in their own rights, specifically describes the present invention.

None of the prior art particularly describes a novel timepiece with removable and interchangeable panels with a sports motif. Accordingly, there is a constant need for new and innovative ideas to create new styles.

SUMMARY OF THE INVENTION

In view of the foregoing disadvantages inherent in the prior art, an object of the invention is to provide a time device having options for changing the decorative fixtures of the time device.

Another object of the invention is to provide a time device capable of removably attaching a motif depiction.

Yet another object of the invention is to provide flexibility of choice in order to attach a motif as desired.

Still yet another object of the invention is to provide a sports motif with detachable figures simulating a playing action of said sports.

To achieve above and other objects, the invention provides a device for displaying time comprising: a time piece with interchangeable and attachable panels having decorative indicia or figures, and a set of timing hands having replaceable indicia or figures.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figures 2, 3:
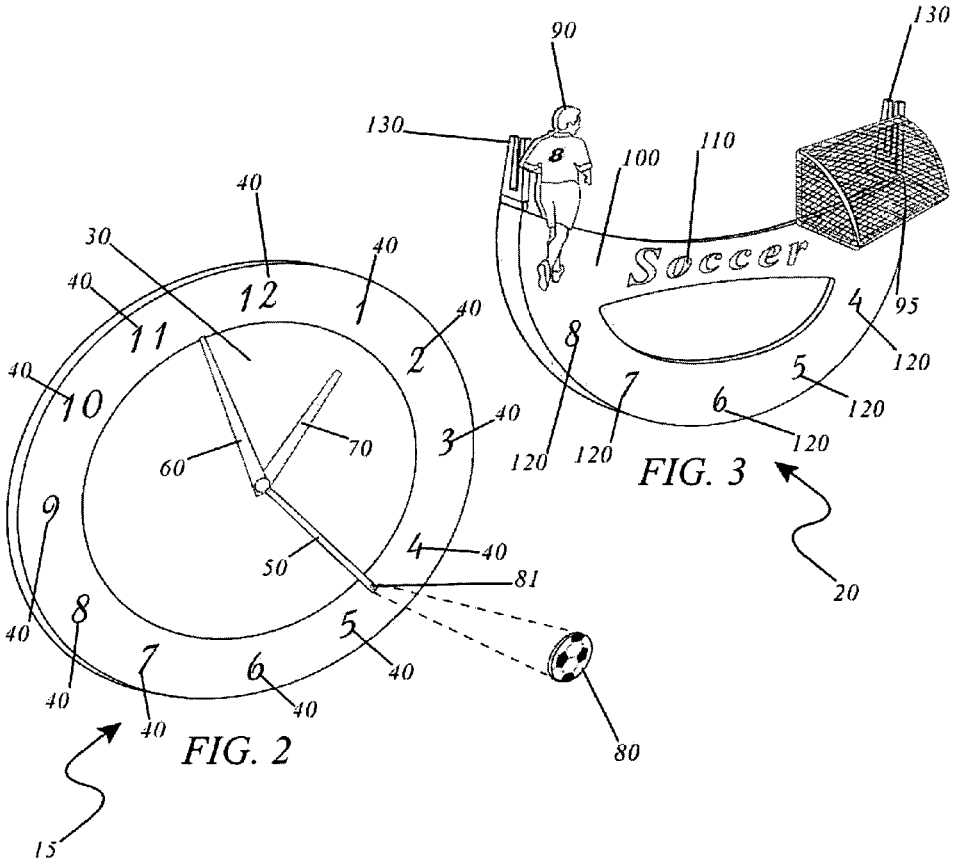
FIG. 3 is a pictorial view of the panel with the sports motif, according to a preferred embodiment of the present invention.

10 clock with sports motif
15 conventional clock
20 panel
30 clock face
40 clock numbers
50 second hand
60 minute hand
70 hour hand
80 second hand attachable figure
81 attachment point
90 9:00 position sports figure
95 3:00 position sports figure
100 bridge
110 indicia
120 panel numbers
130 retaining clip

DETAILED DESCRIPTION OF THE PREFERRED EMBODIMENT

Figure 1:
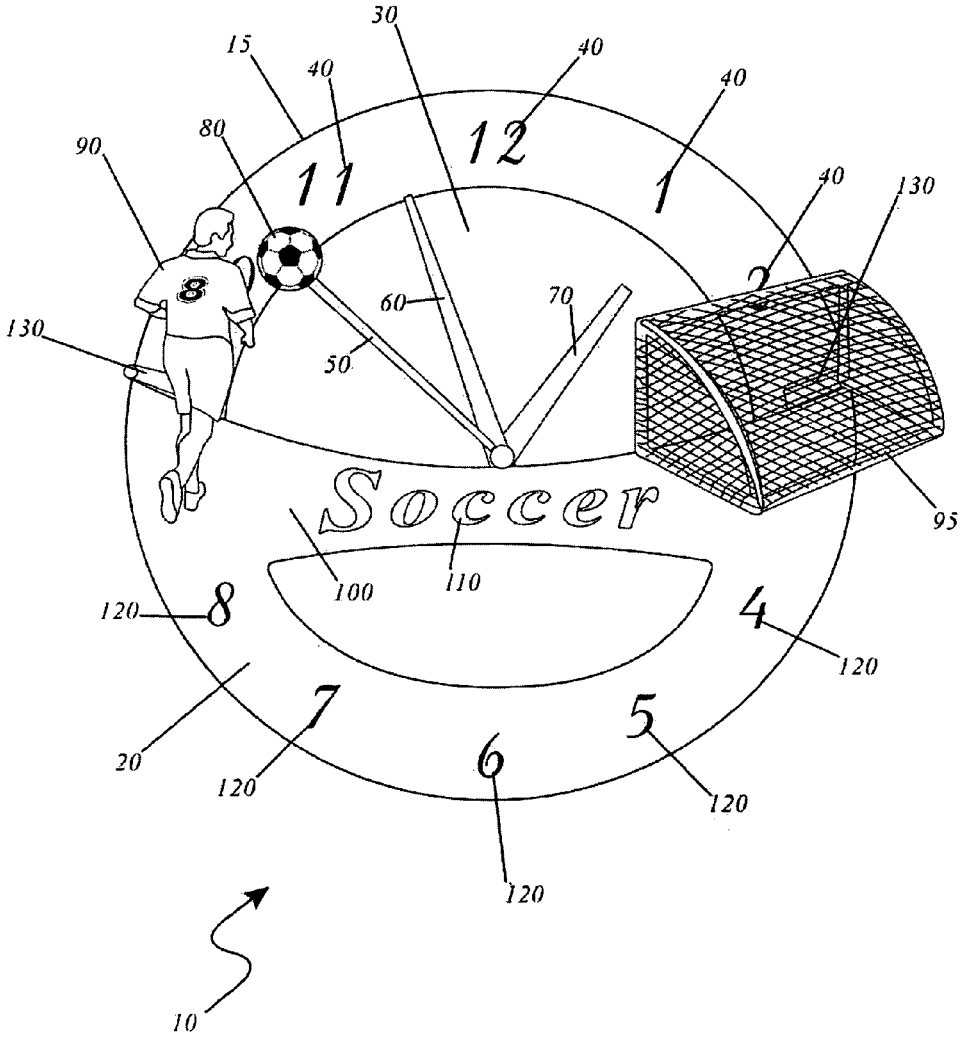
FIG. 1 is a front view of a clock with a sports motif 10, according to a preferred embodiment of the present invention; and, FIG. 2 is a pictorial view of a conventional clock 15 upon which a panel 20 is affixed thereto, according to a preferred embodiment of the present invention.

The best mode for carrying out the invention is presented in terms of its preferred embodiment, herein depicted within FIGS. 1 through 3. However the invention is not limited to the described embodiment, and a person skilled in the art will appreciate that many other embodiments of the invention are possible without deviating from the basic concept of the invention any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a front view of the timepiece, and in this embodiment a clock, with a sports motif 10 (herein described as the clock) is disclosed in accordance with the preferred embodiment of the present invention, specifically a soccer motif. The clock 15 generally comprises a clock face 30 with numbers 40 representing the hours of the day located around the outer circumference of the clock face 30; a second hand 50 located closest to the clock face 30; a minute hand 60 above the second hand 50; and an hour hand 70 above the minute hand 60. A timing means drives said second 50, minute 60, and hour hands 70. A panel 20 is removably secured to the bottom half of the clock 15 with specific sports indicia affixed at approximately the 9:00 position 90 and 3:00 position 95.

The clock face 30 is circular in shape and may be manufactured out of any solid material, such as plastic, paper, or metallic material. It has numbers 40 representing the hours of the day located circumferentially about its front surface. A motor connected to a series of clockwork gears provides movement to the second 50, minute 60, and hour hands 70 has power supplied to it via an electrical cord carrying electricity from a conventional wall socket or replaceable batteries. Alternatively, power can be supplied by kinetic energy by moving the timepiece. The second hand 50 is closest to the clock face 30 and has a removable FIG. 80 on the end of it, representing a "driven" object relative to the specific sports motif of the clock 10. The removable FIG. 80 is attached to the second hand 50 by fastening means on an attachment point 81 located at the distal end of the second hand 80. The minute hand 60 follows next with the hour hand 70 on top. Each hand 50, 60, 70 is driven by separate gears and is manufactured out of suitable material.

The bottom portion of the clock comprises a removable panel 20 that is semi-circular in shape with a bridge 100 spanning the diameter of the of the panel 20 and a depth that maintains a distance away from the clock face 30 so as to not interfere with the movements of the hands 50, 60, 70. The bridge 100 and semi-circular shape of the panel 20 defines a viewing port wherein the second 50, minute 60, and hour hands 70 are visible as they travel downward toward the bottom of the clock 10. About the outer surface of the panel 20 there are a series of numbers 120 of a similar ornamental design as the numbers 40 on the clock face 30 to represent the hours of the day, ranging from 4:00 to 8:00. At the 9:00 position on the panel, in place of a number, a specific sports FIG. 90 based on the prevailing motif is affixed thereto. In particular, the sports FIG. 90 here consists of a player or object simulating the driving of the related sports FIG. 80 attached to the second hand 50. At the 3:00 position on the panel, in place of a number, another sports-related FIG. 95 relative to the prevailing sports motif is affixed in thereto. In particular, the figure at the 3:00 position 95 "receives" the FIG. 80 located on the second hand 50. Indicia 110 or a logo describing the sports motif is printed across the bridge 100 portion of the panel 20. Clips 130 on the outer side wall of the panel 20 retain the entire panel 20 to the clock 15. Alternatively, the panel 20 can be removably secured to the clock 15 by magnetic means.

The entire clock with sports motif 10 may be manufactured and sold in kit form, including different sports motifs as desired by the final user.

The invention matrix is a line of time devices/timepieces with various motifs and the preferred embodiment of the present invention focuses on depiction of soccer as the earmarked theme. Upon initial observation of the invention, it appears like a conventional analog type wrist watch or clock 10 with an hour 70, minute 60, and second hand 50. However, after closer examination, it can be seen that all of the clocks 10 feature a ball 80 on the end of the second hand 50 which appears to have been thrown or kicked by a player 90 located at the 9:00 position. The player 90 or ball 80 would vary depending on the sport theme being depicted, but is envisioned to include such models as a soccer ball being kicked into a goal, a baseball being thrown to a batter, or a football being kicked through a goal post. The target area 95 would be located approximately at the 3:00 position, the ball 80 would then disappear behind a shield 20, but the second hand 50 would remain visible. The ball 80 would then reappear by the player 90 at the 9:00 position giving the appearance of being thrown or kicked once again. The minute 60 and hour hands 70 also travel behind the shield 20 with a portion of each hand being visible through the portal in much the same way the second hand 50 remains visible.

The present invention, after being procured by the user, is basic, simple, and ornamental in nature. The user supplies power to the clock 15 and mounts the clock 15 in the desired location. The indicia 110 and FIGS. 80, 90, 95 based on a specific sports motif on the clock 10 will dictate what movements of the clock's hands 50, 60, 70 will follow. In the case of the preferred embodiment, FIG. 1 shows a soccer player on the left side of the clock (at approximately the 9:00 position) 90 and a soccer goal on the opposite (3:00) side 95. The second hand 50 of the clock 15 has a FIG. 80 on the end of it in the general shape of a soccer ball and is physically closest to the clock face 30. During movement, the second hand 50 travels in a clockwise manner from the soccer player's position 90 until it reaches the general area of the soccer goal 95, whereby it will travel behind the panel 30 until it reaches the position of the player 90. The minute 60 and hour 70 hands travel behind the panel 30 as well and function in a similar fashion to those of a conventional analog clock.

The simulation of the soccer player 90 "kicking" the soccer ball 80 on the end of the second hand 50 into the soccer goal 95 provides a pleasing and entertaining means of displaying time. This ornamental design of a sports motif may be interchanged with other indicia 110 and FIGS. 80, 90, 95 located on removable panels 30 including, but not limited to: basketball, hockey, and football.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated. It is understood that various omissions and/or substitutions of equivalents are contemplated as circumstance, may suggest or render expedient, but is intended to cover the application or implementation without departing from the spirit or scope of the claims of the present invention.

What is claimed is:

1. A device for displaying time comprising:

a round clock having a circular outer edge;

an interchangeable and attachable panel having decorative indicia or figures, said interchangeable and attachable panel being directly and removably conjoined to said clock in such a manner that said interchangeable and attachable panel is positioned along an outermost surface of said device;

a set of timing hands having replaceable indicia or figures, said timing hands being positioned posterior of said interchangeable and attachable panel and further intercalated between said clock and said interchangeable and attachable panel respectively;

wherein said interchangeable and detachable panel further comprises a semi-circular shape and a depth large enough to permit unimpeded movement of said timing hands, said interchangeable and detachable panel also having hour displaying indicia thereupon;

wherein said interchangeable and detachable panel further comprises a bridge spanning the distal ends of said interchangeable and detachable panel and defining a viewing port for unhindered viewing of said set of timing hands, said bridge having upper most edges terminating at diametrically opposed sides of said clock;

wherein said interchangeable and detachable panel has at least a pair of hinged clamps located at a 9:00 position and a 3:00 position of said interchangeable and detachable panel, said clamps removably attach said interchangeable and detachable panel to said clock on a bottom portion of said clock wherein said bottom portion of said clock is defined as between a 3:00 position and a 9:00 position, wherein said hinged clamps extend upwardly and away from said upper most edges of said bridge;

wherein said clock further comprises an analog clock with hour displaying indicia thereupon its front surface and means to mount said clock on a vertical surface;

further comprising an attachment point for attaching said indicia or figure, said attachment point being directly situated on a front face of said interchangeable and attachable panel respectively.

* * * * *